United States Patent [19]

Green

[11] Patent Number: 4,891,842

[45] Date of Patent: Jan. 2, 1990

[54] SOUND OUTPUT UNIT FOR INSTALLATION IN A CEILING STRUCTURE

[75] Inventor: Daniel N. Green, Portland, Oreg.

[73] Assignee: Posh Diversified, Inc., Lake Oswego, Oreg.

[21] Appl. No.: 173,246

[22] Filed: Mar. 24, 1988

[51] Int. Cl.[4] ..... H04R 1/02

[52] U.S. Cl. ..... 381/188; 181/150; 381/152; 381/153; 381/158; 381/159

[58] Field of Search ..... 381/188, 205, 87–90, 381/152, 153, 158, 159; 181/150, 153

[56] References Cited

U.S. PATENT DOCUMENTS

| | | | |
|---|---|---|---|
| 2,713,396 | 7/1955 | Tavares | 181/199 |
| 2,744,584 | 5/1956 | Hellon | 181/150 |
| 3,388,298 | 6/1968 | Sabonis | 381/205 |
| 3,666,040 | 5/1972 | Junk | 181/150 |
| 3,953,675 | 4/1976 | Babb | 181/148 |
| 3,985,200 | 10/1976 | Sepmeyer | 181/199 |
| 4,168,761 | 9/1979 | Pappanikolaou | 181/199 |
| 4,173,267 | 11/1979 | Chatani | 181/148 |
| 4,196,792 | 4/1980 | Grieves et al. | 181/199 |
| 4,200,170 | 4/1980 | Williams, Jr. | 181/199 |
| 4,280,586 | 7/1981 | Petersen | 181/199 |
| 4,289,929 | 9/1981 | Hathaway | 381/188 |
| 4,330,691 | 5/1982 | Gordon | 381/205 |
| 4,424,881 | 1/1984 | Hattori | 181/150 |
| 4,439,643 | 5/1984 | Schweizer | 381/90 |
| 4,454,927 | 6/1984 | Seebinger | 181/150 |
| 4,484,658 | 11/1984 | Grote | 381/188 |
| 4,727,587 | 2/1988 | Black | 381/205 |

FOREIGN PATENT DOCUMENTS

| | | | |
|---|---|---|---|
| 849421 | 9/1952 | Fed. Rep. of Germany | 381/87 |
| 2706524 | 8/1978 | Fed. Rep. of Germany | 181/150 |
| 2804922 | 8/1979 | Fed. Rep. of Germany | 381/88 |
| 3248340 | 12/1983 | Fed. Rep. of Germany | 381/205 |

*Primary Examiner*—Jin F. Ng
*Assistant Examiner*—Danita R. Byrd

[57] ABSTRACT

The present invention constitutes a sound output unit for installation in a ceiling structure including an assembly for mounting a loudspeaker for use in conjunction with said output unit. The sound output unit comprises a polyhedral chamber or enclosure, a loudspeaker, an amplifier, and two sets of baffles. The polyhedral chamber is specially shaped in order to help reduce resonant vibrations. The loudspeaker is mounted in a large opening in the bottom plate of the enclosure so that it can radiate sound out from the enclosure into the area below the ceiling structure in which the unit has been installed. The amplifier is secured on the top of the loudspeaker inside the chamber and provides local power amplification. The baffles are mounted on the interior surfaces of the top and bottom plates of the enclosure and help reduce spurious sound reflections within the enclosure. The loudspeaker is mounted in the bottom plate of the enclosure by means of special mounting assembly which allows the loudspeaker and a cover plate for the loudspeaker to be efficiently and rapidly secured in place.

9 Claims, 3 Drawing Sheets

SOUND OUTPUT UNIT FOR INSTALLATION IN A CEILING STRUCTURE

BACKGROUND OF THE INVENTION

The present invention relates to speaker units for audio systems and to arrangements for installing the loudspeakers of sound systems into ceiling structures.

Until the present time, little effort has been expended in optimizing audio output units for installation in ceiling structures. Frequently, loudspeakers for providing overhead sound were simply mounted on the backsides of plastic or metal grilles which were then suspended above the ceiling, or alternatively, conventional stereo cabinets were mounted in the ceiling structure. As a consequence, the audio output produced by such units tended to be of poor quality.

It is, therefore, an object of the present invention to provide an audio output unit for installation in a ceiling structure which is optimized for providing high fidelity sound in that environment.

It is a further object of the present invention to provide an audio output unit which may be quickly and conveniently installed in a conventional ceiling structure.

It is another object of the present invention to provide an output unit which takes advantage of the efficiencies inherent in local power amplification in a system for distributing sound to multiple locations.

It is a yet further object of the present invention to provide an assembly for conveniently and securely mounting a loudspeaker in an audio output unit and for installing the audio unit in a ceiling structure including a layer of sheet material.

It is yet another object of the present invention to provide an assembly for mounting a loudspeaker in an audio unit in a ceiling structure which provides for the rapid and yet secure mounting of an aesthetically pleasing cover plate over the opening for the loudspeaker.

SUMMARY OF THE INVENTION

The present invention constitutes a sound output unit for installation in a ceiling structure and an assembly for mounting a loudspeaker for use in conjunction with said output unit. The sound output unit comprises a polyhedral chamber or enclosure including a top plate, a bottom plate, and four lateral plates which form the sides of the enclosure. The plates on opposite sides of the enclosure are inclined with respect to one another in order to help reduce resonant vibrations and eliminate standing waves within the enclosure. The output unit also includes a loudspeaker, an amplifier, and two sets of baffles. The loudspeaker is mounted in a large opening in the bottom plate of the enclosure so that it can radiate sound out from the enclosure into the area below the ceiling structure in which the unit has been installed. The amplifier is secured on the top of the loudspeaker inside the chamber and provides local power amplification. The baffles are mounted on the interior surfaces of the top and bottom plates of the enclosure and help reduce spurious sound reflections within the enclosure.

The assembly for mounting the loudspeaker is integrated with the bottom plate of the enclosure and includes a recessed shoulder, a ring and a cover plate. The recessed shoulder extends inwardly from the edge toward the center of the opening in the bottom plate and serves to mount the loudspeaker. The ring projects outward from the surface of the bottom plate and functions as an abutment for the sheet material of the ceiling structure. The cover plate is secured to the ring and covers the opening in the bottom plate while allowing sound to radiate from the output unit into the area below.

DESCRIPTION OF THE PREFERRED EMBODIMENT

Figure 1:
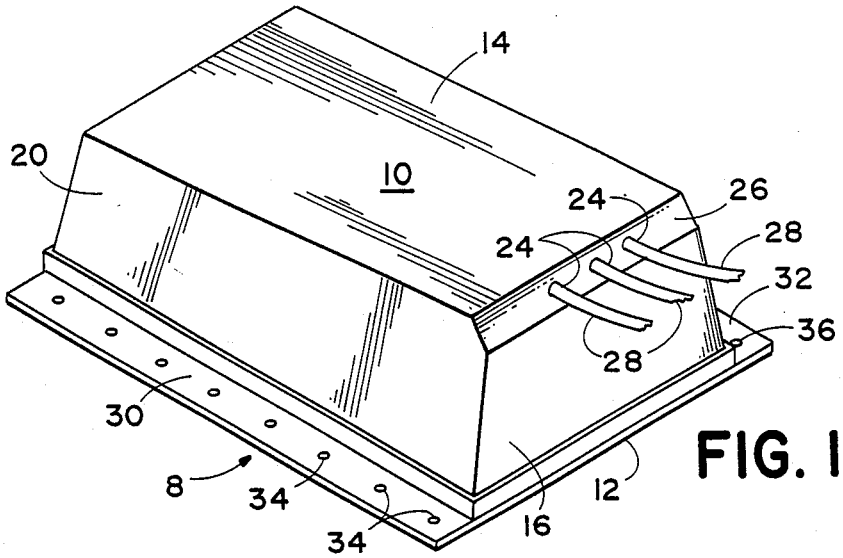
FIG. 1 is a perspective view of the sound output unit of the present invention.

Referring now to FIG. 1, the present invention comprises an output unit 8 including a polyhedral enclosure 10 having roughly the shape of a truncated pyramid. The enclosure 10 is manufactured from high impact plastic which is injection molded to produce the required parts for the enclosure 10. The enclosure 10 is formed from six plates including a bottom plate 12, a top plate 14, and four lateral plates 16, 18 (not shown in FIG. 1), 20 and 22 (not shown in FIG. 1) which function as the various sides of the polyhedral enclosure 10. One of the lateral plates 16 includes three small openings 24 along an inclined section 26 which allow the passage of three sets of signal and power cables 28 into the enclosure 10. The bottom plate 12 extends outward from the polyhedral structure on two opposite sides to form a pair of flat sections 30 and 32 which each include sets of very small collinear holes such as the holes 34 and 36.

Figure 2:
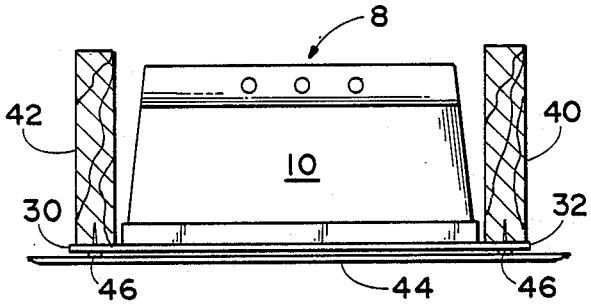
FIG. 2 is an end view of the sound output unit of the present invention installed in a ceiling structure.

Referring now to FIG. 2, the output unit 8 is illustrated as installed in a ceiling structure including 2 inch by 8 inch stud boards 40 and 42 on sixteen inch centers and a layer of sheet material 44 such as sheet rock which forms the ceiling boundary with the area or room below. The enclosure 10 of the output assembly 8 is adapted to fit into the ceiling structure between the stud boards 40 and 42 on top of the sheet material 44. The outward extending sections 30 and 32 run along the bottom edges of stud boards 40 and 42 and allow the enclosure 10 to be secured to the ceiling structure prior to installation of sheeting 44 by fasteners 46 such as nails which are driven up through the holes in the sections 30 and 32 into the framing members or boards 40 and 42. The bottom plate 12 extends along the top surface of ceiling material 44.

Figure 3:
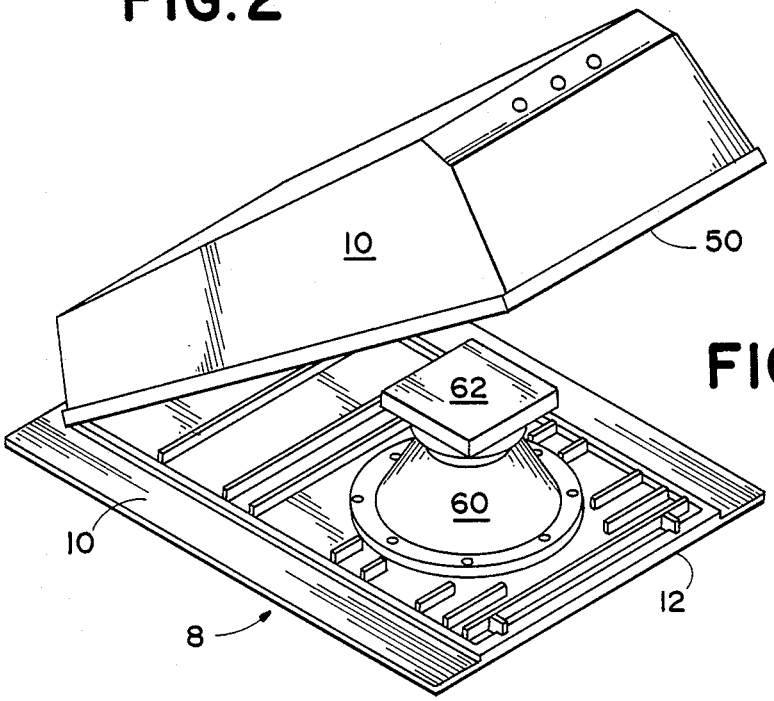
FIG. 3 is a perspective view of the sound output unit of the present invention with the top part of the enclosure of the unit rotated upward to show the components of the unit interior to the enclosure.

Referring now to FIG. 3, the output unit 8 is illustrated with the top part 50 of the enclosure 10 rotated up from the plate 12 of the bottom part of the enclosure 10 in order to show the operational units of the output unit 8 which are internal to the enclosure 10. The loudspeaker 60 is mounted on the bottom plate 12 and extends upward from the plate 12 into the interior of the enclosure 10. The loudspeaker 60 functions to radiate sound out from the enclosure 10. The amplifier 62 is also interior to the enclosure 10 and is mounted on the top end of the loudspeaker 60. The amplifier 62 functions to amplify the power of audio signals supplied by the cables 28 and provide the required electrical energy for the operation of the loudspeaker 60. The position of the amplifier 62 on top of the loudspeaker allows it, among other things, to benefit from increased air-cooling due to the vibrational action of the loudspeaker 60 which is especially pronounced at low frequencies when the greatest cooling is required.

Figure 5:
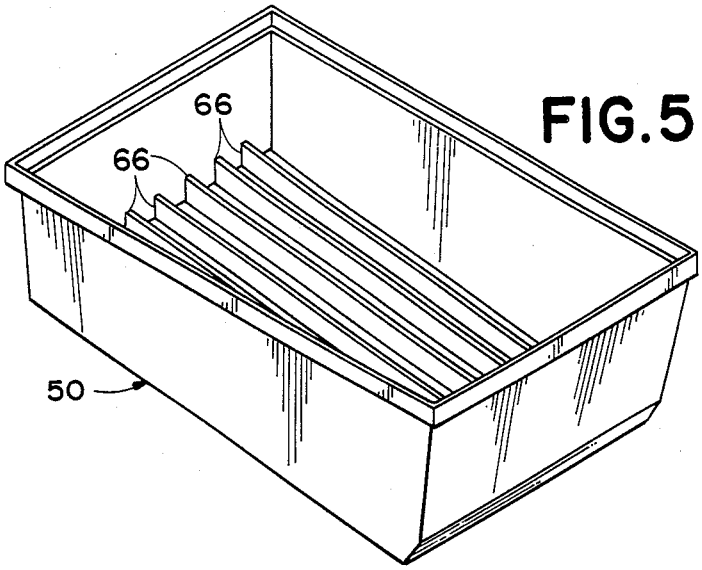
FIG. 5 is an upside down perspective view of the top plate of the enclosure component of the sound output unit of the present invention.
Figure 4:
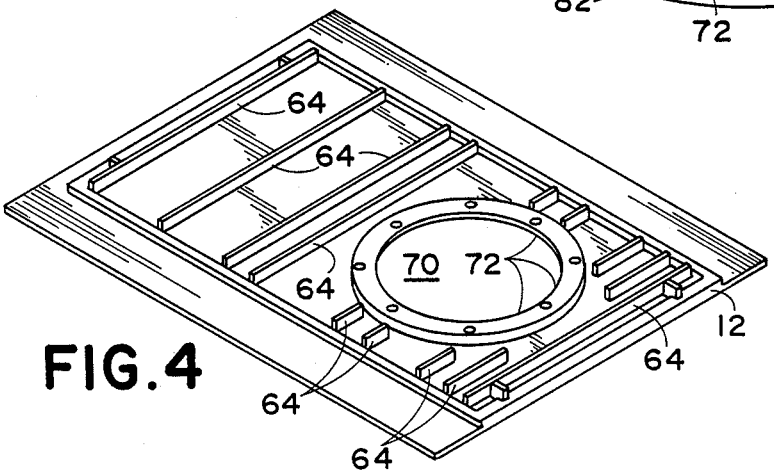
FIG. 4 is a perspective view of the topside of bottom plate of the enclosure component of the sound output unit of the present invention.

Referring now to FIGS. 4 and 5, the structures of the top and bottom parts of the enclosure 10 and particularly of the bottom plate 12 and top plate 14 are shown in greater detail. The bottom plate 12 includes a large opening 70 defined by a circular inner edge 72. The opening 70 is operative for mounting the loudspeaker 60 and allowing sound to be radiated out of the enclosure 10 from the loudspeaker 60. A set of eleven parallel baffles 64 are mounted on the bottom plate 12 interior to the enclosure 10. The baffles 64 extend up about one and one-half inches from the top surface of the plate 12 and function to help reduce miscellaneous reflection and echoing of sound within the enclosure 10 which might contaminate the sound provided by the loudspeaker 60. A set of seven parallel baffles 66, similar to the baffles 64, are mounted on the top plate 14 interior to the enclosure 10 and extend down about one and one-half inches from the surface of the plate 14. The baffles 66 are positioned so as to be perpendicular to the baffles 64 and thereby complement the action of the baffles 64 in helping to reduce sound reflection and echoing within the enclosure 10.

Figure 6:
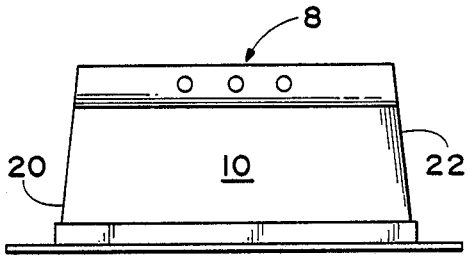
FIG. 6 is an end view of the enclosure component of the sound output unit of the present invention.
Figure 7:
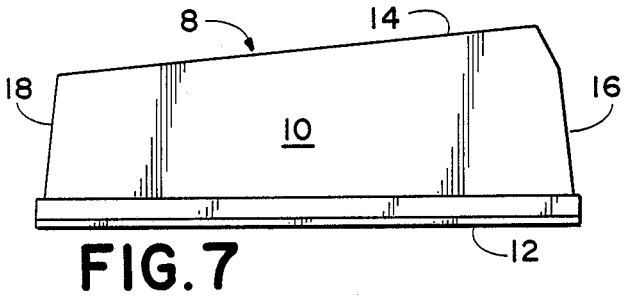
FIG. 7 is a side view of the enclosure component of the sound output unit of the present invention.

Referring now to FIGS. 6 and 7, the output unit 8 is illustrated in an end view and a side view, respectively, which more clearly show the inclined or "skewed" orientations of the opposite sides of the enclosure 10. The planes defined by the top and bottom plates 12 and 14 are slanted and are not parallel to each other. Likewise the planes defined by the plates 16 and 18 and 20 and 22 are slanted and are not parallel to each other. The slanted or nonparallel orientations of the opposite sides of the enclosure 10 helps to suppress the development of resonant vibrations at specific frequencies within the enclosure 10.

Figure 9:
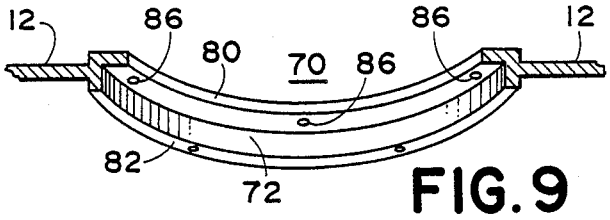
FIG. 9 is a perspective view of the opening for the loudspeaker in the bottom plate of the enclosure component of the present invention.
Figure 8:
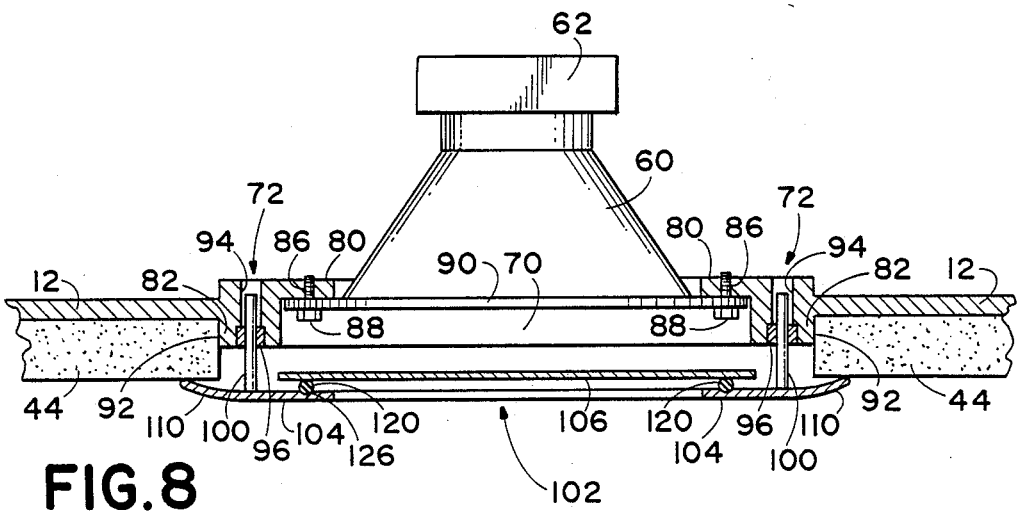
FIG. 8 is a cross sectional view of the assembly for mounting the loudspeaker and cover plate assembly in the bottom plate of the enclosure component of the present invention.

Referring now to FIG. 8 and also FIG. 9, the assembly for mounting the loudspeaker 60 in the bottom plate 12 of the enclosure 10 and for installing the output unit 8 over the sheet material 44 is shown in detail. As most clearly shown in FIG. 9, the inner edge 72 of the bottom plate 12 includes a shoulder 80 and a ring 82 both of which extend circularly around the opening 70. The shoulder projects inward toward the center of the opening 70 and is recessed from the exterior surface of the plate 12 toward the interior of the enclosure 10. The shoulder 80 functions as a bracket for mounting the loudspeaker 60 and the amplifier 62 which is attached to the loudspeaker 60. As shown in FIG. 8, the shoulder 80 includes a set of threaded holes such as the holes 86 for receiving fasteners such as the bolts 88 which are operative for securing the frame 90 for the loudspeaker 60 against the shoulder 80 and thereby mounting the loudspeaker 60 in the opening 70. The ring 82 projects outward from the surface of the plate 12. The ring 82 serves as an abutment to the sheet material 44 of the ceiling which borders on the outer edge 92 of the ring 82. The ring 82 also includes a set of holes such as the holes 94 which have fasteners 96 installed at their lower ends. The fasteners are of the tinnerman-type and are adapted to engage and grip a set of studs such as the studs 100 extending up from the cover plate 102. The studs 100 and fasteners 96 allow the cover plate 102 to be quickly installed over the opening 70. The cover plate 102 includes a disc 104, a screen 106 extending across the disc 104 and the aforementioned studs 100 which project up from the disc 104. The periphery of the disc 104 is formed into a circular tip section 110 which is curved upward from the plane of the disc 104. Since the disc 104 is composed of material having some elastic properties such as molded plastic the tip section 110 cooperates with the studs 100 in holding the cover plate 102 firmly in position. When the cover plate 102 is installed and the studs are pushed home into the fasteners 96, the tip section 110 presses on the sheet material 44 thereby elastically deforming the disc 104 and tensioning the engagement of the studs 100 with the fasteners 96. This tensioning action results in the cover plate being firmly secured to the plate 12 so that the plate will not vibrate in response to sound from the loudspeaker 60.

Figure 10:
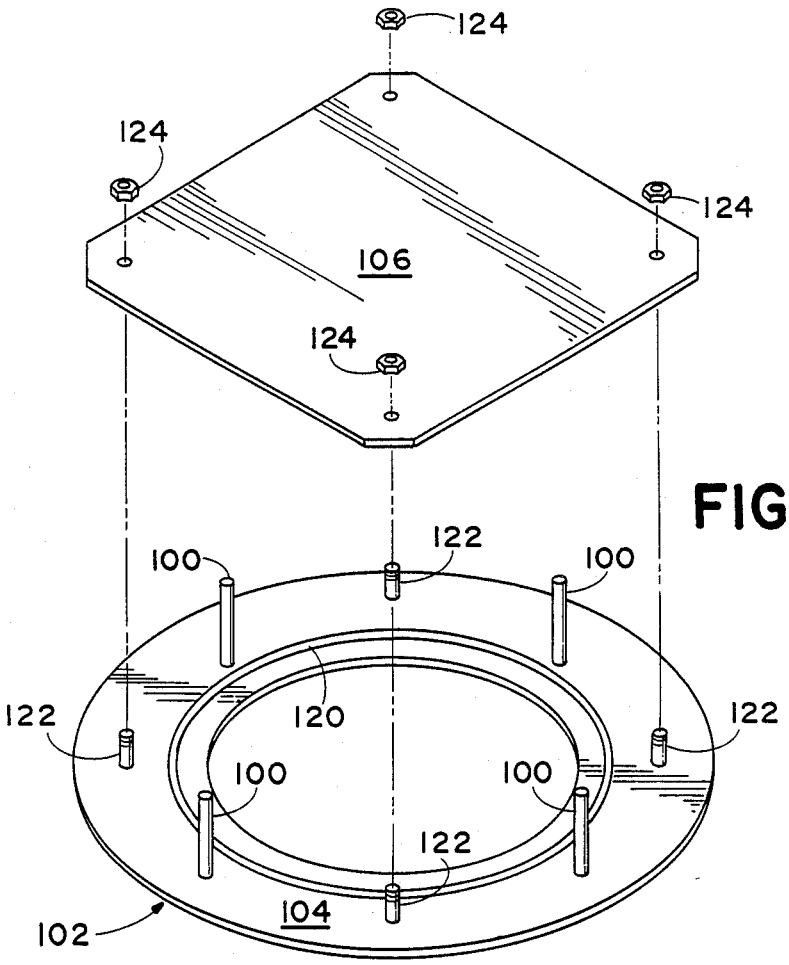
FIG. 10 is a perspective view of the cover plate of the assembly of the present invention for mounting the loudspeaker.

Referring now to FIG. 10, the cover plate 102 includes the disc 104, screen 106, and studs 100. The disc 104 is annular in form. The screen 106 is square-shaped but has sufficient dimensions to extend across the inner portion of the disc 104 and fully cover the opening in the disc 104. The material for the screen 106 is selected on the basis of its aesthetic appeal and sound transfer characteristics. In particular the material for the screen 106 should be chosen to provide substantial sound dispersion at high frequencies. The studs 100 are cylindrical and are adapted to fit snuggly in the fasteners 96. However, the cover plate also includes an O-ring 120, a set of risers 122 and a set of self-tapping nuts 124 which fit onto the risers 122. The O-ring 120 is made of rubber-like material and fits between the disc 104 and the screen 106 in a circular depression 126 set into the disc 104. The O-ring 120 functions to reduce vibrations by the screen 106. The risers 122 are spaced around and permanently attached to the disc 104. The risers 122 extend up through holes in the corners of the screen 106. The nuts 124 are threaded on the risers 122 for securing the screen 106 onto the disc 104 over the O-ring 120.

As may be apparent from the preceding description, certain changes may be made in the above constructions without departing from the scope of the invention. Therefore, the embodiment described and the drawings are intended to be illustrative in nature and are not meant to be interpreted as limiting the following claims.

I claim:

1. An assembly for mounting a loudspeaker in a ceiling including a layer of sheet material, said assembly comprising:

a mounting plate having an inner edge defining a circular opening;

a circular ring extending down from the inner edge of said plate around said opening for forming an abutment to said sheet material of said ceiling;

a recessed circular shoulder extending inward from the inner edge of said plate around said opening for mounting a loudspeaker in said opening; and a cover plate for covering said opening in said mounting plate, said cover plate including a screen and adapted for being removably mounted onto said circular ring in said mounting plate.

2. The assembly of claim 1, wherein said cover plate includes:

a set of studs extending up from said plate in a pattern matching the shape of said circular ring, and wherein said circular ring includes:

a set of openings having fasteners for engaging said studs.

3. The assembly of claim 2, wherein said cover plate is comprised of elastic material and includes:

a circular tip section extending around the periphery of said cover plate for engaging said sheet material and tensioning said studs against said fasteners.

4. A sound output unit adapted for installation in a ceiling structure having parallel stud boards and a layer of sheet material, said unit comprising:

a polyhedral acoustic chamber including a bottom plate having an inner edge defining an opening, a top plate and two pairs of side plates forming three pairs of opposite sides for said chamber which are slanted in orientation with respect to another for reducing resonant vibrations;

a loudspeaker mounted in said bottom plate of said chamber for radiating sound outward from said output unit through said opening;

a plurality of baffle ribs mounted along the interior of said chamber for suppressing sound reflections;

a pair of flat sections extending out from said bottom plate of said chamber for mounting said chamber to said stud boards of said ceiling structure, and means for mounting said loudspeaker in said bottom plate, said mounting means including a ring extending down from said inner edge of said bottom plate around said opening for forming an abutment to said sheet material of said ceiling, a recessed shoulder extending inward from the inner edge of said plate around said opening for mounting said loudspeaker in said opening, and a cover plate including a screen, said plate adapted for being removably mounted onto said ring from below said opening in said bottom plate.

5. An assembly for mounting a loudspeaker in a ceiling structure, said assembly comprising:

a mounting plate having an inner edge defining a circular opening and including a set of fasteners positioned around said opening for locking onto studs;

means for mounting said loudspeaker in said opening;

a cover plate for covering said opening in said mounting plate, said cover plate including:

a main body in the form of an annular ring having a central opening;

a set of studs extending upward from said main body for engaging said fasteners in said mounting plate, a foraminous screen extending over said circular opening for allowing sound to pass through said cover plate, means for damping any vibration by said screen.

6. The assembly of claim 5, wherein said mounting plate further includes:

a circular ring for forming an abutment to said ceiling structure which extends down from said inner edge of said mounting plate and on which said fasteners are mounted.

7. The assembly of claim 6, wherein said means for mounting said loudspeaker includes:

a recessed shoulder extending inward from the inner edge of said mounting plate around said opening.

8. The assembly of claim 5, wherein said cover plate further includes:

a circular tip section extending around the periphery of said cover plate for engaging said ceiling structure and tensioning said studs against said fasteners.

9. The assembly of claim 5, wherein the damping means of said cover plate, includes:

an O-ring mounted between said main body and foraminous screen.

* * * * *